US005249527A

United States Patent [19]

Schwind

[11] Patent Number: 5,249,527

[45] Date of Patent: Oct. 5, 1993

[54] HIGH SPEED, INFLATING BAG INFRARED COUNTERMEASURE

[75] Inventor: Richard G. Schwind, Los Gatos, Calif.

[73] Assignee: Westinghouse Electric Corp., Pittsburgh, Pa.

[21] Appl. No.: 907,084

[22] Filed: Jul. 1, 1992

[51] Int. Cl.[5] ..... F42B 12/70; F41J 2/00

[52] U.S. Cl. ..... 102/354; 89/1.11

[58] Field of Search ..... 102/354, 348, 293, 386, 102/530, 364; 89/1.11

[56] References Cited

U.S. PATENT DOCUMENTS

| | | | |
|---|---|---|---|
| 2,447,972 | 8/1948 | Weinert | 102/354 |
| 3,109,607 | 11/1963 | Lally | 102/354 |
| 3,229,290 | 1/1966 | Fisher | 102/354 |
| 3,478,687 | 11/1969 | Craig | 102/354 |
| 3,626,854 | 12/1971 | Brooks | 102/348 |
| 3,930,448 | 1/1976 | Barber et al. | 102/348 |
| 4,421,007 | 12/1983 | Hanes | 89/1.11 |
| 5,060,973 | 10/1991 | Giovanetti | 102/530 |

*Primary Examiner*—David H. Brown
*Attorney, Agent, or Firm*—D. Schron

[57] ABSTRACT

An IR decoy which includes an aerodynamic shell from which is deployable an aerodynamically shaped thin film, high temperature, high strength plastic bag. A first stage of a two stage gas generator initially deploys and inflates the bag while the second stage maintains the bag in its inflated condition and provides IR radiation within a desired wavelength band to which the plastic bag is substantially transparent.

12 Claims, 5 Drawing Sheets

HIGH SPEED, INFLATING BAG INFRARED COUNTERMEASURE

BACKGROUND OF THE INVENTION

1. Field of the Invention

The invention in general relates to countermeasure devices, and more particularly to an infrared decoy for countering heat seeking missiles.

2. Background Information

Infrared (IR) generating decoys are used to attract heat seeking missiles which will home in on the decoy itself rather than on the vessel or aircraft which launched the decoy.

A typical heat seeking missile countermeasure involves the use of an IR flare which is ejected or launched into the atmosphere to attract the heat seeking missile away from the intended target. One problem associated with such flares is that the production of infrared energy is greatly curtailed by mixing and dilution with the air stream.

Another decoy device is of the type which is shot up into the atmosphere by a missile which deploys a spherical, high temperature inflatable bag which drifts in the atmosphere for tens of seconds. The bag, which is black, contains a hot radiating gas which heats up the bag such that the bag radiates relatively long wavelength IR from its surface.

The present invention provides for an IR decoy device which maximizes the energy available for radiation and which is particularly well adapted for an aerodynamic launch from a moving aircraft.

SUMMARY OF THE INVENTION

Infrared decoy apparatus for launching into the atmosphere, such as deployment from an aircraft, includes, in accordance with the present invention, an aerodynamic shell which contains a gas generator means. Also stored within the shell is a thin film, high temperature bag which is connected to and deployable from the shell. Means are provided for initiating the gas generator means after a launch of the decoy to deploy and inflate the bag which is substantially transparent to the wavelength of IR radiation produced by the hot gas within the bag. The bag includes an exit means to allow the gas within the bag to slowly escape from its interior. In a preferred embodiment, the gas generator means includes first and second stages wherein the first stage is operable to supply an initial, cooler gas at high mass flow to quickly deploy and inflate the bag without burning the bag. The second stage is operable to supply the interior of the bag with hotter gas with particulates to sustain its inflated condition and to radiate the IR radiation.

DESCRIPTION OF THE PREFERRED EMBODIMENTS

Figure 1:
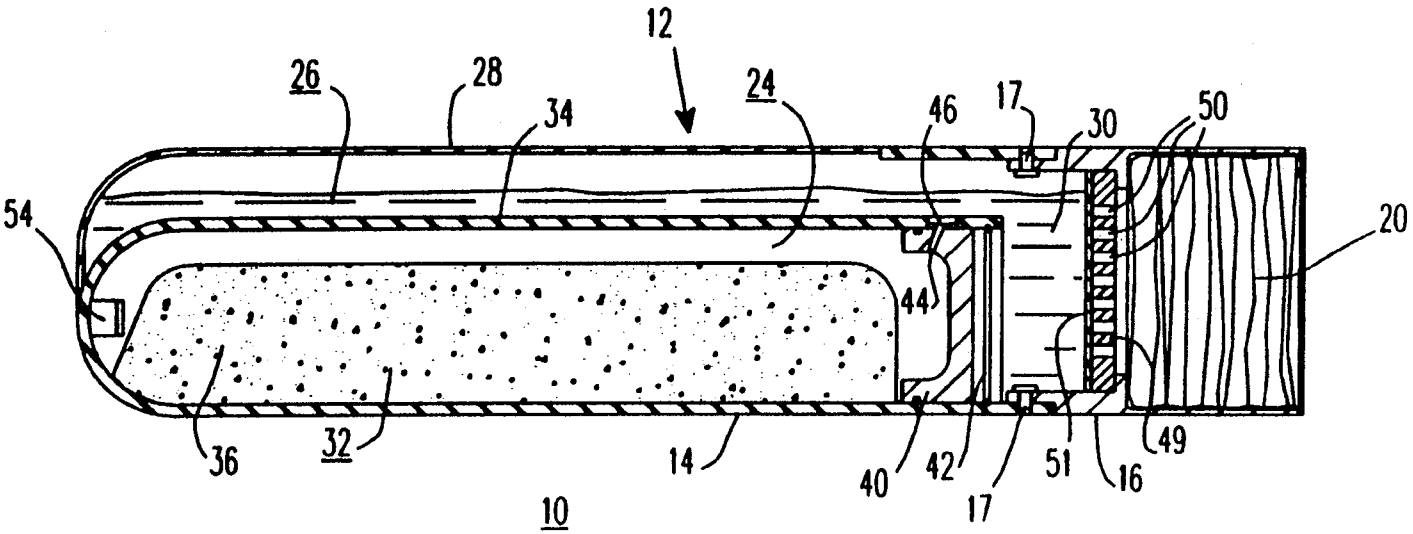
FIG. 1 is a cross-sectional view of one embodiment of the invention.

Referring now to FIG. 1, there is illustrated IR decoy apparatus 10 having an outer aerodynamic shell 12 comprised of two sections 14 and 16, joined to one another by means of fasteners 17.

The second section 16 carries a thin film, high temperature, high strength plastic bag 20 which is bonded to section 16 and stored in a folded condition until being provided with gas, whereupon the bag will deploy from the rear of the second section 16.

In order to supply the bag with gas, the first section 14 includes gas generator means 24. In the embodiment of the invention illustrated in FIG. 1, the gas generator means 24 includes first and second stages with the first stage 26 being located in a first compartment 28 of the first section 14 and being constituted by a liquid propellant or diluent such as propane 30. The second stage 32 is . located in a second compartment 34 of the first section and may be constituted by a solid propellant 36 comprised of a fuel such as sodium nitride, polymeric hydrocarbons; oxidizers such as cupric oxide, ammonium potassium or lithium perchlorate, potassium sodium or ammonium nitrate; and particulates such as silicon, aluminum, titanium or zirconium oxides, and silicon or zirconium carbides, by way of example. It is to be noted that the particulate additive may be in addition to the precipitates normally produced from the products of combustion.

An end plug 40 is located at the rear of second compartment 34 and is held in position by means of a retainer clip 42. A nozzle 44 defined within end plug 40 communicates the second compartment 34 with the first compartment 28, however the communication is initially blocked by means of a barrier 46 which may be a blow out plug.

The first compartment 28 is separated from the bag containing second section 16 by means of a flow diffuser bulkhead 49. This bulkhead has a plurality of apertures 50 therethrough and is sealed by means of a rupturable thin film barrier 51 which maintains the integrity of the first compartment 28 to prevent propane leakage.

In operation when the decoy 10 is launched into the atmosphere such as by ejection from an aircraft, an igniter 54 is activated to ignite the solid propellant 36. As a result of this ignition, the pressure in compartment 34 increases to a point where barrier 46 at the exit of nozzle 44 is ruptured causing a mixture of the hot gas with the propane 30. Propane 30 thus becomes vaporized with a consequent increase in pressure in compartment 28 to a point where thin film barrier 51 ruptures and gas flow causes deployment and initial inflation of gas bag 20.

Figure 2A:
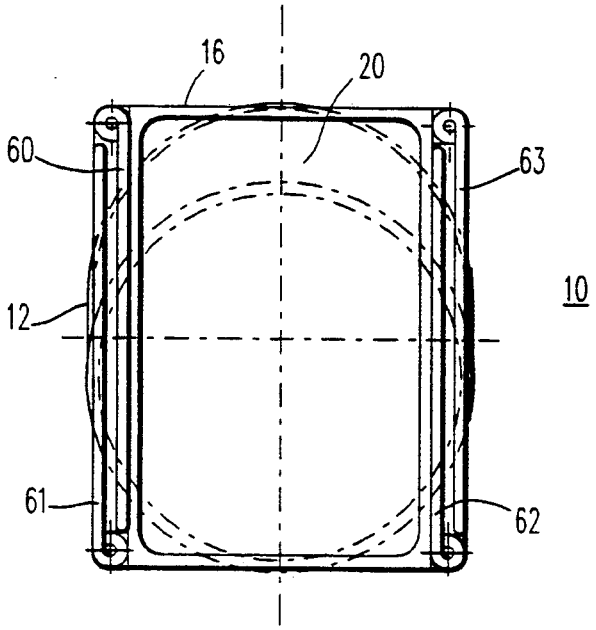
FIG. 2A illustrates an end view of the device of FIG. 1 showing the stabilizing fins in a stowed condition and FIG. 2B illustrates the fins in a deployed condition.
Figure 2B:
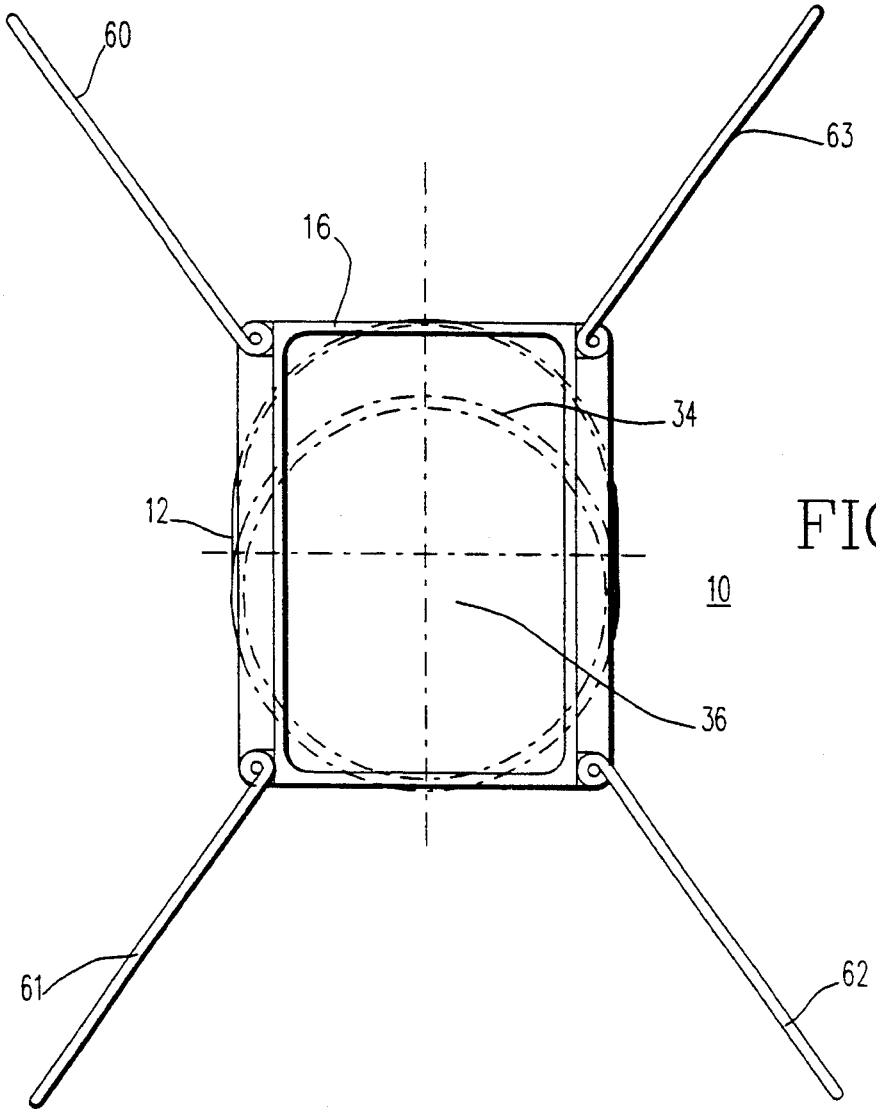

Upon ejection from the aircraft, the decoy 10 deploys stabilizing fins connected to second section 16. With additional reference to FIG. 2A, there is illustrated a rear view of decoy 10 showing spring loaded deployable fins 60 to 63 just prior and held in place against action of the springs by containment in the launching equipment (not shown). When free of the aircraft launching equipment, the fins spring open to assume the orientation as illustrated in FIG. 2B, for stabilizing purposes.

Figure 3:
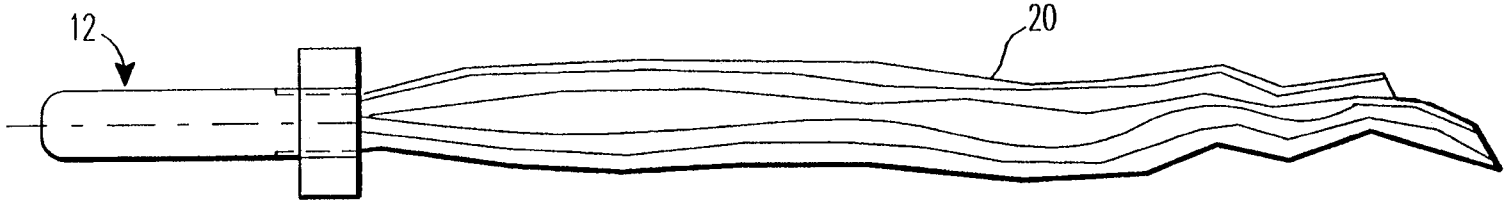
FIG. 3 illustrates the initial deployment of a gas containing bag associated with the decoy.
Figure 4:
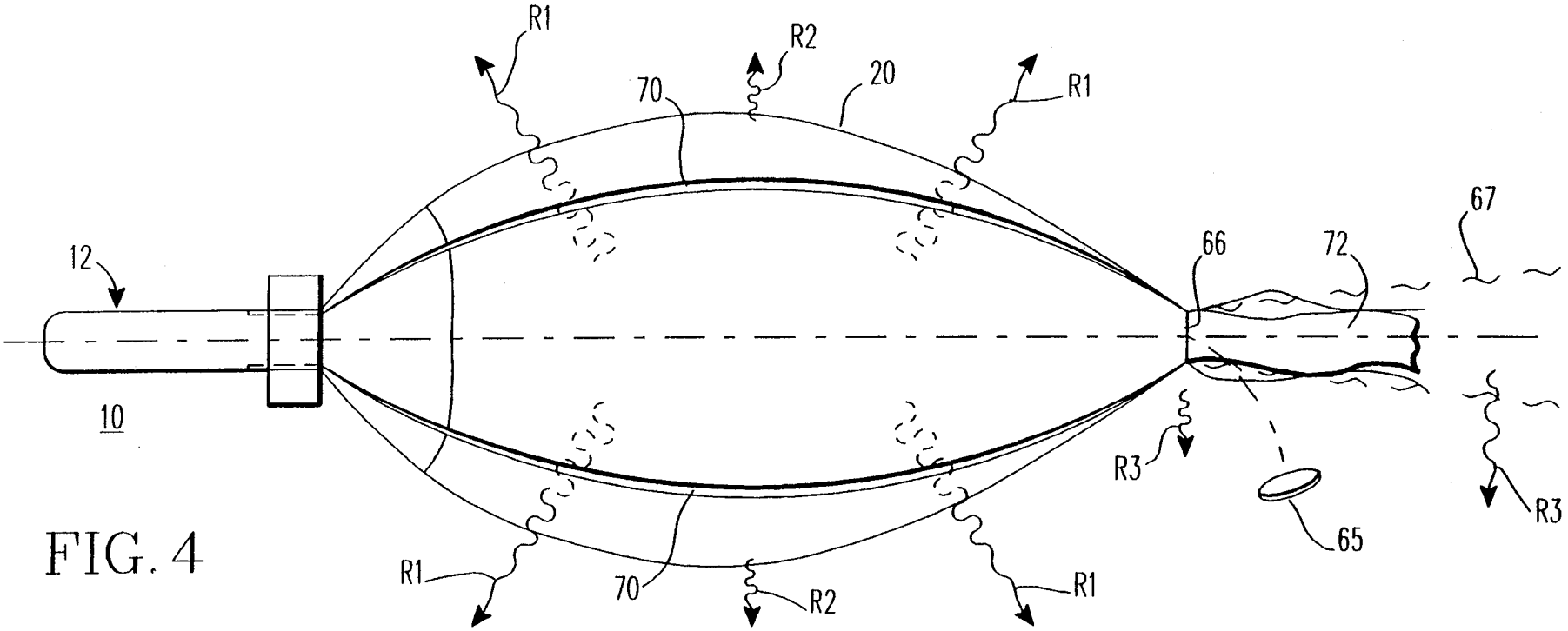
FIG. 4 illustrates the bag in its deployed condition.

As illustrated in FIG. 3, a relatively low temperature mixture of propane gas and solid propellant gas products is operable to quickly deploy the bag 20 from section 16 and to commence bag inflation. When fully inflated, and as illustrated in FIG. 4, a blow out plug 65 which previously had been sealing an exit aperture 66 is ejected, thus allowing escape of gas from the interior of bag 20. This produces a hot jet or wake 67, depending upon the decoy velocity. The aperture is sized to regulate the escaping gas flow so an adequate internal pressure (several psi) is maintained in the bag for adequate structural stiffness.

During, and in particular, after the inflation of bag 20, its interior becomes filled with a relatively higher temperature hot gas with particulates, provided by the burn of the second stage solid propellant 36 (FIG. 1). The particulates in the hot gas within the bag 20 produce radiation centered on a certain wavelength bandwidth to which the bag material is substantially transparent. This radiation from the interior of the bag is represented by arrows R1. During operation, the material of bag 20, to some extent, absorbs some of the radiation and will in turn emit a secondary radiation designated by arrows R2. A third source of radiation R3 also occurs from the hot jet or wake 67 where the hot gases are being released to the atmosphere. If desired, the radiation profile, that is, the intensity of radiation forward relative to the sides and rear, can be shaped locally by treating the bag film material with either a reflective coating or a layer of high temperature flexible insulating material such as silicone elastomer which would reduce the transmissibility. Such coatings may also be applied to the seams 70 to prevent overheating due to reduced transmittance of the multiple overlapping layers which would occur at the seams. Further, different thicknesses of films can be used in different regions of the bag 20 to maximize its radiation effectiveness and strength.

In view of the fact that the hot radiating gases containing particulates are contained within a substantially IR transparent bag, the decoy can be operated over a large range of flight conditions with very little change in radiation performance since the IR energy would not be modified by the various cooling effects of wind pressure. However, the wind does cool the bag adequately to prevent the bag 20 of high temperature plastic film from overheating.

Figure 5:
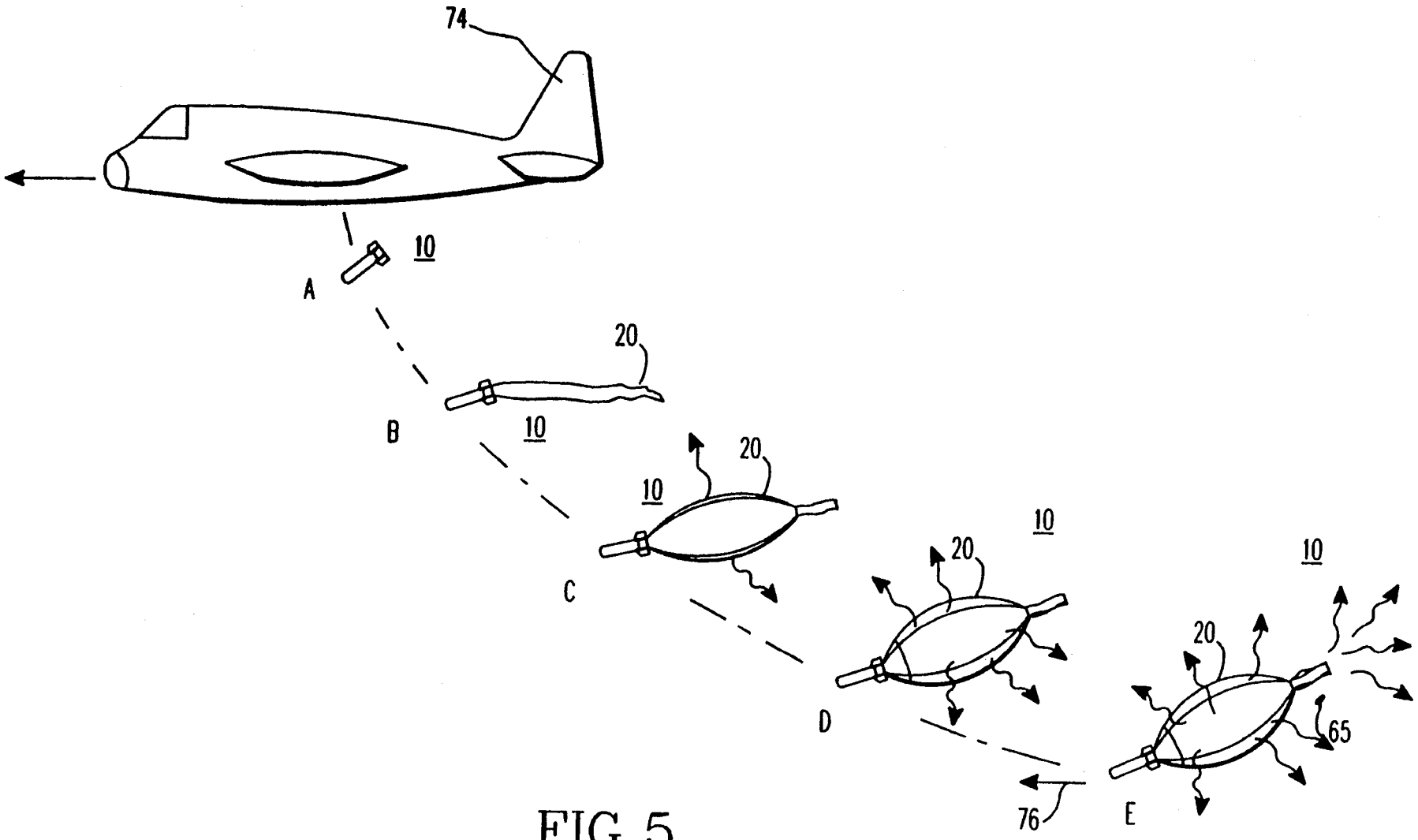
FIG. 5 illustrates the launch of the decoy from an aircraft.

The deployed bag 20 has an aerodynamic, shape which is generally ellipsoidal in front and of tapering shape toward the rear to minimize its drag. The device may be further stabilized with the addition of stabilizing streamers 72 affixed to the bag 20 around the exit 66. The bag 20 may flap back and forth behind the outer aerodynamic shell 12 and still perform as described. FIG. 5 illustrates a typical deployment of the decoy 10 from an aircraft 74. At position A the decoy 10 (not to scale) has deployed its fins. At position B the gas generator means causes propane gas to initially deploy the bag 20. Position C illustrates the bag 20 during its initial inflation and some IR radiation due to the gas generated by the propane and solid propellant. At position D, when the bag 20 is near full inflation, a proportionally larger amount of IR radiation is provided and at position E, bag 20 is fully inflated, blow out plug is ejected, maximum IR radiation is being transmitted and the decoy 10, due to its aerodynamic shape, falls through the atmosphere with a forward moving component as indicated by arrow 76.

Figure 6:
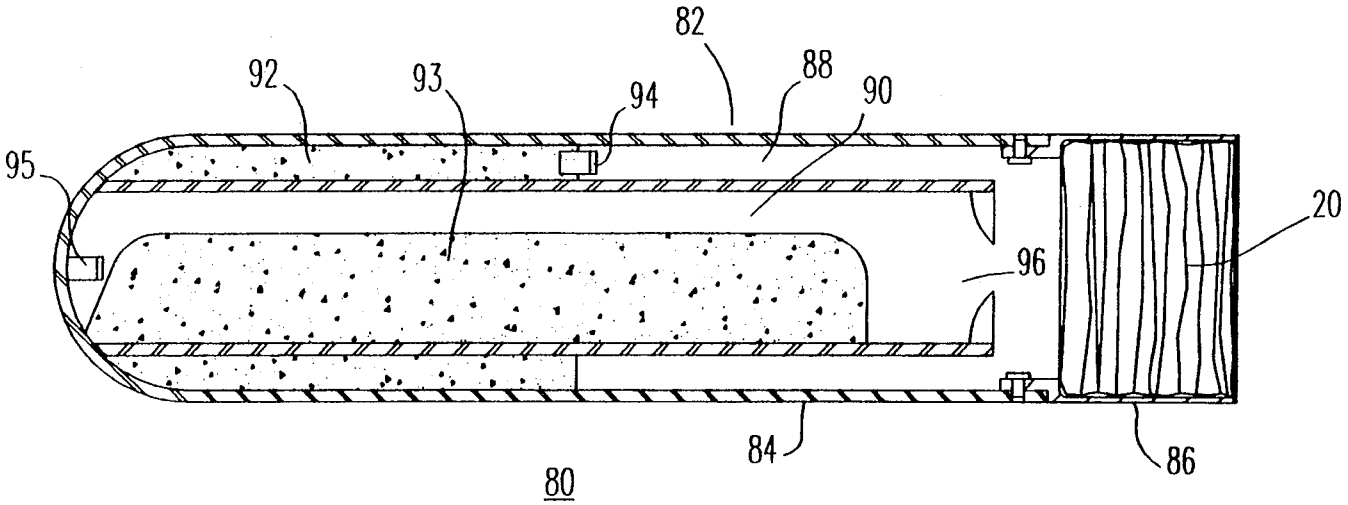
FIG. 6 is a cross-sectional view of an alternative embodiment of the present invention.

In FIG. 6 there is illustrated an IR decoy 80 having an aerodynamic shell 82 comprised of a first section 84, containing gas generator means, and a second section 86 affixed thereto and containing a deployable plastic bag substantially transparent to the radiation produced by the gas generator means when the bag is fully inflated.

The forward section 84 includes a first compartment 88 and a second compartment 90, with a gas generator means being constituted by a solid state propellant 92 disposed in the first compartment 88 and a second solid state propellant 93 disposed in the second compartment 90. Each of the solid state propellants 92 and 93 include a respective igniter 94, 95 operable such that igniter 94 is fired first causing the solid state propellant 92 to provide a relatively low temperature gas at a high mass flow rate to deploy and initially inflate the plastic bag carried in compartment 86. Thereafter, igniter 95 is activated such that solid state propellant 93 provides a relatively hotter gas at a lower flow rate through nozzle 96 to maintain the bag in its inflated condition and to provide the IR radiation within a desired bandwidth.

I claim:

1. Infrared (IR) decoy apparatus for launching into the atmosphere, comprising:

a) an aerodynamic shell;

b) gas generator means contained within said shell;

c) a thin film, high temperature bag stored within and deployable from said shell;

d) means for initiating said gas generator means after a launch of said decoy, to deploy and inflate said bag with hot gas containing particulates;

e) said bag being substantially transparent to the wavelength of IR radiation produced by said hot gas with particulates, within said bag; and f) said bag being connected to said shell so as to continually receive said gas during operation, said bag including exit means for allowing said gas to escape from the interior of said bag.

2. Apparatus according to claim 1 wherein:

a) said bag is stored in a rear compartment of said shell.

3. Apparatus according to claim 1 which includes:

a) a stopper for initially blocking said exit means when said bag is being deployed and inflated, after which said stopper is ejected by the pressure of gas within said bag.

4. Apparatus according to claim 1 wherein:

a) said shell is comprised of two sections;

b) a first of said sections containing said gas generator means; and c) the second of said sections being affixed to said first section and containing said bag.

5. Apparatus according to claim 1 which includes:

a) a plurality of spring loaded stabilizing fins each of which folds against said shell and held in position against action of said spring prior to decoy launch and being operable, by action of said spring, to deploy into an operating stabilizing orientation after said decoy is launched.

6. Apparatus according to claim 5 wherein:

a) said shell is comprised of two sections;

b) a first of said sections containing said gas generator means;

c) the second of said sections being affixed to said first section and containing said bag; and d) said stabilizing fins being connected to said second section.

7. Apparatus according to claim 1 wherein:

a) said gas generator means includes first and second stages;

b) said first stage being operable to supply an initial cooler gas at high mass flow to deploy and inflate said bag without burning the bag; and c) said second stage being operable to supply the interior of said bag with hot gas with particulates to sustain its inflated condition and to radiate said IR radiation.

8. Apparatus according to claim 7 wherein:

a) said first stage is a liquid propellant; and b) said second stage is a solid propellant.

9. Apparatus according to claim 7 wherein:

a) said first stage is a solid propellant; and b) said second stage is also a solid propellant.

10. Apparatus according to claim 1 wherein:

a) said bag, when inflated, has an aerodynamic generally ellipsoidal forward section and a generally tapered rear section.

11. Apparatus according to claim 10 wherein:

a) said exit means is located at the end of said tapered section.

12. Apparatus according to claim 11 which includes:

a) a plurality of streamers disposed about said exit means to enhance aerodynamic stability of said bag.

* * * * *